US010604962B1

(12) United States Patent
Givens et al.

(10) Patent No.: US 10,604,962 B1
(45) Date of Patent: Mar. 31, 2020

(54) BARRIER INFILL SYSTEM

(71) Applicant: Ameristar Perimeter Security USA Inc., Tulsa, OK (US)

(72) Inventors: Fred L. Givens, Tulsa, OK (US); Michael D. Elmore, Tulsa, OK (US); Bryan L. Hudson, Tulsa, OK (US); Robert W. Nichols, Tulsa, OK (US)

(73) Assignee: Ameristar Perimeter Security USA Inc., Tulsa, OK (US)

( * ) Notice: Subject to any disclaimer, the term of this patent is extended or adjusted under 35 U.S.C. 154(b) by 634 days.

(21) Appl. No.: 15/365,274

(22) Filed: Nov. 30, 2016

Related U.S. Application Data

(60) Provisional application No. 62/261,708, filed on Dec. 1, 2015.

(51) Int. Cl.

| | |
|---|---|
| ***E04H 17/16*** | (2006.01) |
| ***E04H 17/14*** | (2006.01) |
| ***E04F 11/18*** | (2006.01) |
| ***E04H 17/24*** | (2006.01) |

(52) U.S. Cl.
CPC ..... *E04H 17/16* (2013.01); *E04F 11/1855* (2013.01); *E04H 17/1413* (2013.01); *E04H 17/161* (2013.01); *E04H 17/168* (2013.01); *E04H 17/24* (2013.01)

(58) Field of Classification Search
CPC ..... E04H 17/16; E04H 17/1413; E04H 17/10; E04H 17/12; E04H 17/161; E04H 17/163; E04H 17/165; E04H 17/166; E04H 17/168; E04H 17/24; E04F 11/1855; E04F 2011/1823
USPC ..... 256/24, 31, 65.01, 65.02, 65.14, 73, 35, 256/47, 54; 52/465, 506.06, 506.08, 780, 52/716.1
See application file for complete search history.

(56) References Cited

U.S. PATENT DOCUMENTS 1,122,829 A * 12/1914 Wernimont ..... E04H 17/266 294/134
2,335,361 A * 11/1943 Schiller ..... E06B 9/52 160/395
2,464,814 A * 3/1949 Kautz ..... E04H 17/16 52/799.12
2,723,107 A * 11/1955 Parker ..... E04H 17/20 256/24
3,552,476 A * 1/1971 Le Tarte ..... E06B 9/52 160/371
3,770,245 A * 11/1973 Murdock ..... E04F 11/1851 256/24
4,324,388 A * 4/1982 Klaser ..... E04H 17/1413 256/13.1

(Continued)

FOREIGN PATENT DOCUMENTS

DE 19634796 A1 * 3/1998 ..... E04H 17/003

*Primary Examiner* — Matthew R McMahon
(74) *Attorney, Agent, or Firm* — Gary Peterson

(57) ABSTRACT

A barrier framework is formed from vertical posts and horizontal rails. Infill sections cover major openings in the barrier framework. Elongate junction elements overlay each rail and join adjacent infill sections. Edges of the infill sections fit within channels formed in the junction elements. Each junction element has an H-shaped cross-sectional profile, with the arms on one side shorter than those on the other. A cover element encloses the shorter arms of each junction element and clamps infill material against the longer arms.

26 Claims, 17 Drawing Sheets

(56) References Cited

U.S. PATENT DOCUMENTS 5,341,610 A * 8/1994 Moss ..... E04B 1/3211 52/199
5,542,649 A * 8/1996 Allegaert ..... E04H 17/003 256/32
5,556,080 A * 9/1996 Vise ..... E04H 17/003 248/74.5
5,702,090 A * 12/1997 Edgman ..... E04H 17/1421 256/19
6,142,701 A * 11/2000 Falcon ..... E01F 13/028 160/24
6,415,564 B1 * 7/2002 Beer ..... E04H 17/10 256/47
7,121,530 B1 * 10/2006 Preta ..... E04H 17/1413 256/65.04
7,380,379 B2 * 6/2008 Venegas, Jr. ..... E04H 9/10 256/73
7,461,489 B2 * 12/2008 Herbertsson ..... E04H 17/165 256/22
7,866,635 B2 * 1/2011 Payne ..... E04H 17/161 256/24
8,382,070 B1 2/2013 Gibbs
8,387,955 B2 * 3/2013 Ptacek ..... E04H 17/163 256/24
8,573,565 B1 * 11/2013 Lyndaker ..... A63B 71/0054 256/23
8,783,661 B1 7/2014 Payne
8,910,925 B2 * 12/2014 Payne ..... E04H 17/161 256/25
9,284,770 B2 * 3/2016 Sprague ..... E06B 3/308
9,371,642 B2 * 6/2016 Herbertsson ..... E04B 1/38
9,441,384 B2 * 9/2016 Rosati ..... E04G 21/3223
9,453,356 B2 * 9/2016 Lyndaker ..... A63B 71/0054
9,458,645 B1 * 10/2016 King ..... E04H 17/14
9,470,014 B2 * 10/2016 Volin ..... E04H 17/161
2002/0066898 A1 * 6/2002 Meis ..... E06B 11/02 256/73
2006/0113517 A1 * 6/2006 Colantonio ..... E04H 17/168 256/24
2007/0145340 A1 * 6/2007 Brabeck ..... E04H 17/163 256/24
2007/0163189 A1 * 7/2007 Venegas, Jr. ..... E04H 9/10 52/222
2008/0277639 A1 * 11/2008 Huang ..... E04H 17/168 256/24
2010/0200825 A1 * 8/2010 Hill ..... E04H 17/16 256/24
2010/0288989 A1 * 11/2010 Williams ..... E04H 17/143 256/59
2011/0062404 A1 * 3/2011 Shepherd ..... E04H 17/161 256/34
2011/0168963 A1 * 7/2011 Bowman ..... B21F 33/02 256/24
2013/0248794 A1 * 9/2013 Callahan ..... E04H 17/00 256/73
2013/0256618 A1 * 10/2013 Hayter ..... E04H 17/1413 256/24
2014/0191174 A1 * 7/2014 Ditta ..... E04G 21/3204 256/31
2014/0252293 A1 * 9/2014 Miller ..... E06B 11/02 256/73
2016/0047140 A1 * 2/2016 Knudsen ..... E04H 17/165 256/24
2016/0145891 A1 * 5/2016 McCarty ..... E04H 17/1413 256/24
2016/0305151 A1 * 10/2016 Bodrogi ..... E04H 17/22
2017/0096835 A1 * 4/2017 Messelis ..... E04H 17/161
2017/0296941 A1 * 10/2017 Nunes ..... E01F 15/083
2018/0066448 A1 * 3/2018 Cavanagh ..... E04H 17/163

* cited by examiner

21

BARRIER INFILL SYSTEM

SUMMARY OF THE INVENTION

A kit is formed from a plurality of frame components, a plurality of infill sections, a plurality of elongate junction elements, and a plurality of cover elements. The frame components include a plurality of elongate posts and a plurality of elongate rails. The frame components are configured to form an assembled barrier framework in which the frame components cooperate to bound a plurality of major openings.

Each infill section has a pair of spaced longitudinal edges and is configured to fully cover at least one major opening in the assembled barrier framework. Each junction element has a pair of opposed sides and is configured to overlay at least a portion of the length of one of the plurality of rails. Each junction element has at least one elongate channel within which at least a portion of the longitudinal edge of one of the plural infill sections may be received. Each cover element is configured to overlay and enclose at least a portion of the length of one side of a junction element.

A kit is formed from a plurality of frame components, a plurality of infill sections, and a plurality of elongate junction elements. The frame components include a plurality of elongate posts and a plurality of elongate rails. Each rail has an elongate flat attachment surface. The frame components are configured to form an assembled barrier framework in which the frame components cooperate to bound a plurality of major openings.

Each infill section has a pair of spaced longitudinal edges and is configured to fully cover at least one major opening in the assembled barrier framework. Each junction element has a length that equals the length of the attachment surface of one of the plurality of rails. Each junction element has at least one elongate channel within which at least a portion of the longitudinal edge of one of the plural infill sections may be received.

BRIEF DESCRIPTION OF THE DRAWINGS

FIG. 8 is a front elevation view of an infill section.

FIG. 16 is a cross-sectional view of the structure shown in FIG. 15, taken along line 16-16. Fasteners and posts have been omitted.

FIG. 19 is a front elevation view of an assembled barrier. Cover elements have been installed on the structure shown in FIG. 15.

DETAILED DESCRIPTION

Figure 1:
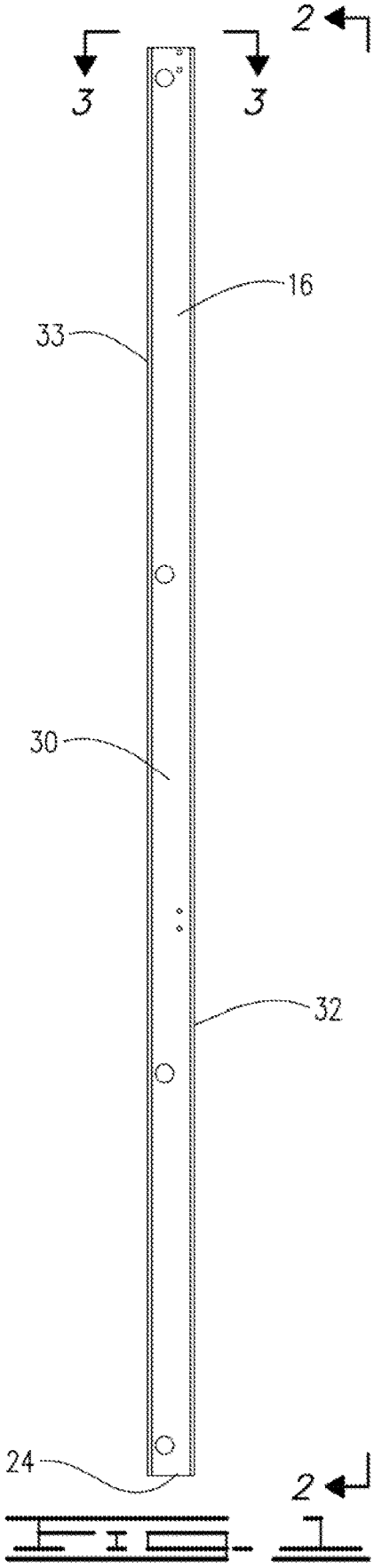
FIG. 1 is a front elevation view of a post.

FIG. 19 illustrates an assembled barrier 10, which may comprise a fence. The barrier 10 is formed from a barrier framework 12, shown in FIG. 7. A plurality of frame components 14 are configured to form the barrier framework 12. The assembled frame components 14 cooperate to bound a plurality of major openings 20 of rectangular shape within the barrier framework 12. A plurality of infill sections 22 fully cover each of these major openings 20.

The frame components 14 include a plurality of elongate posts 16, and a plurality of elongate rails 18. The posts 16 forming the barrier 10 are preferably identical in size, shape and construction.

During the first stage of assembly of the barrier 10, each post 16 is securely anchored at its base 24 into a substrate 26, such as an underground mass of concrete. The depth of the substrate 26 should be at least 3 feet, and may be as much as 5 feet. In the assembled configuration of the barrier 10, each of the posts 16 extends vertically.

The posts 16 are situated along the boundary of the area to be enclosed by the barrier 10. The post spacing should be adequate to impart strength to the barrier 10 and to securely anchor other barrier components. In one preferred embodiment, adjacent posts 16 are separated by a distance no greater than about 6 feet. In another embodiment, adjacent posts 16 are separated by a distance no greater than about 8 feet.

The above-ground height of each installed post 16 is preferably substantially greater than the height of a human or other intruder. In preferred embodiments, the above-ground height of each post is at least 8 feet, and may be 10 feet, or as much as 12 feet. In these preferred embodiments, the total length of each post is at least about 11 feet, and may be as much as about 13 or 15 feet. To protect against moisture, each post 16 may be provided with a solid cap 28 at its upper end.

Each post 16 is preferably formed from a strong and durable material, such as a strip of sheet steel. To enhance its resistance to corrosion, this steel is preferably galvanized. In a preferred embodiment, the steel is characterized by a thickness of 0.11 inches. The galvanized steel strip undergoes a cold rolling process to produce the cross-sectional shape shown in FIG. 3. After cold rolling is complete, a polyester powder coating is preferably applied, to further enhance the post's resistance to corrosion.

Figure 2:
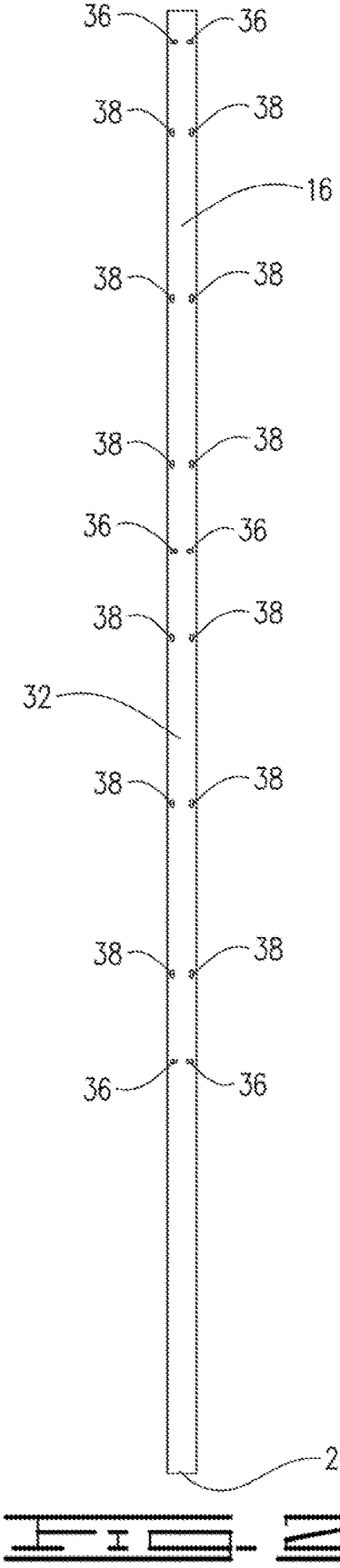
FIG. 2 is a side elevation view of the post shown in FIG. 1, taken along line 2-2.
Figure 3:
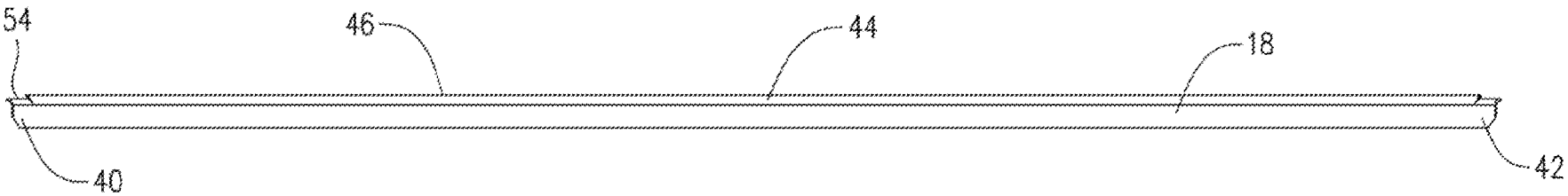
FIG. 3 is a top plan view of the post shown in FIG. 1, taken along line 3-3.

One of the posts 16 is shown in FIGS. 1-3. Each post 16 is preferably characterized by an I-shaped cross section. The post 16 features a flat and elongate web 30 having a pair of laterally spaced edges. Spaced first and second flanges 32 and 33 are formed adjacent each edge of the web 30. The flanges 32 and 33 cooperate with the web 30 to form at least one, and preferably two channel-shaped regions 34. As shown in FIG. 3, the two channel-shaped regions 34 are separated by the web 30.

The web 30 and flanges 32 and 33 preferably comprise regions of the same single piece of material, preferably a strip of sheet steel. Each flange is separated from the adjacent web 30 by a fold in the material. In one embodiment, the web 30 is 3.88 inches in width, while each of the flanges 32 and 33 is 2.75 inches in width.

Each of the flanges 32 and 33 is characterized by a substantially flat double-wall structure, while the flat web 30 is a single-walled structure. The double walls of the flanges 32 and 33 are preferably formed by folding planar portions of steel strip into an overlapping and abutting configuration. This overlapping configuration improves resistance to corrosion and enhances the strength of the post 16.

At least one, and preferably a plurality of fastener openings, designated as rail attachment openings 36, are formed in at least the first flange 32 of the post 16. The number of rail attachment openings 36 formed in a given first flange 32 should be at least as great as the number of rails 18 to be attached to that first flange 32.

Preferably each rail attachment opening 36 in a given first flange 32 is matched with a second rail attachment opening 36 of the same size and shape formed in the same first flange 32 on the opposite side of the web 30. Each opening 36 should be longitudinally positioned at a height that matches the height of one of the rails 18 to be installed in the barrier 10.

In a preferred embodiment, each rail attachment opening 36 has an oblate shape. The major axis of each opening 36 is disposed in perpendicular relationship to the longitudinal axis of the post 16. The width of each opening 36 is about 0.35 inches, and the maximum length is about 0.60 inches. The center-to-center separation distance between paired rail attachment openings 36 on opposite sides of the web 30 is about 1.5 inches.

Figure 22:
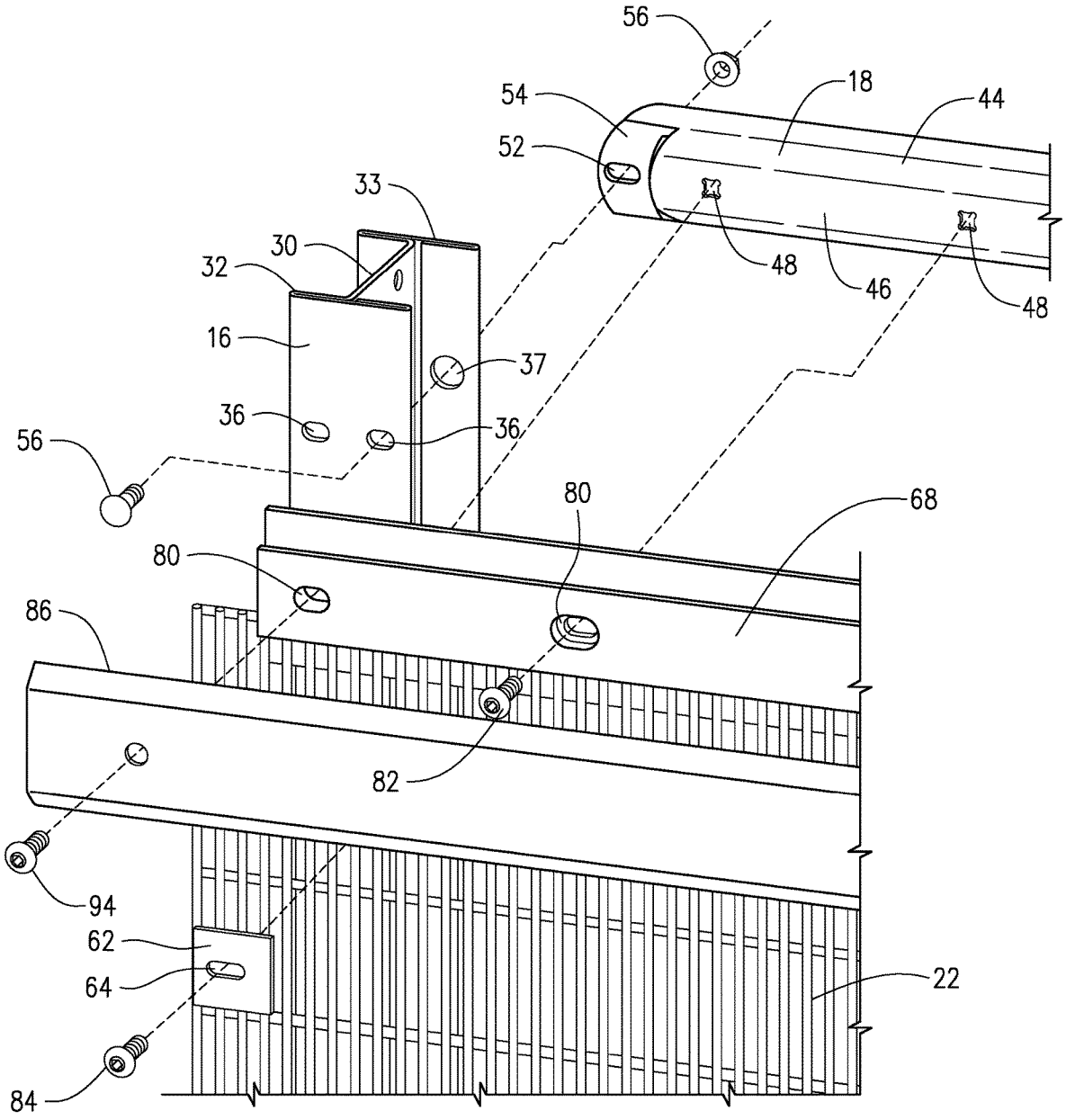
FIG. 22 is an exploded isometric view of an upper portion of the barrier shown in FIG. 19, showing the assembly of a post, rail, junction element, infill section and cover element.

A plurality of enlarged service openings 37, one of which is shown in FIG. 22, are formed in the second flange 33. Each service opening 37 should have the same longitudinal position on the post 16 as a corresponding rail fastener opening 36. Openings 36 and 37 having the same vertical height, and situated on the same side of web 30, should have centers situated within a single plane that extends parallel to the web 30.

Preferably, each service opening 37 is circular in shape, and sized to permit access by a tool within the channel-shaped region 34 of the post 16. The service opening 37 facilitates use of a tool, such as a wrench, to actuate the fasteners 56 that secure posts 16 to rails 18. In one embodiment, the service opening 37 has a diameter of between about 0.75 inches and about 0.88 inches.

At least one, and preferably a plurality of fastener openings, designated as infill attachment openings 38, are formed in at least the first flange 32 of the post 16. Preferably, the infill attachment openings 38 are identical in size. The number of infill attachment openings 38 formed in a given first flange 32 should be at least as great as the number of pad elements 62 on the infill sections 22 to be attached to that first flange 32.

Preferably each infill attachment opening 38 in a given first flange 32 is matched with a second opening 38 formed in the same first flange 32 on the opposite side of the web 30. Each opening 38 should be longitudinally positioned at a height that matches the height of one of the pad elements 62 of an infill section 22 to be installed in the barrier 10.

In a preferred embodiment, each infill attachment opening 38 has an oblate shape. The major axis of each opening 38 is disposed in parallel relationship to the longitudinal axis of the post 16. The width of each opening 38 is about 0.35 inches, and the maximum length is about 0.60 inches. The center-to-center separation distance between paired infill attachment openings 38 on opposite sides of the web 30 is about 1.5 inches.

The rail attachment openings 36 and infill attachment openings 38 are preferably formed by punching holes in the sheet of material from which the post 16 is formed, before it is cold-rolled. Because each of the flanges 32 and 33 is double-walled, two holes must be made in the material for each of the openings 36 and 38 that is formed. When the double-walled flange is formed by folding, the paired holes register and form a single opening.

The rails 18 forming the barrier 10 are preferably of identical size, shape and construction. Each rail 18 is supported at its opposite ends by an adjacent pair of posts 16. At least two, and preferably three or more rails 18 extend between each adjacent pair of posts. The length of each rail 18 should be sufficient to fully span the distance between the adjacent pair of posts 16. In a preferred embodiment, the length of each rail 18 is about 6 feet.

The rails 18 that extend between a given pair of posts 16 are preferably disposed in parallel, vertically spaced relationship. The incline of each rail 18 should substantially match the incline of the terrain on which the pair of posts 16 supporting that rail 18 are installed. Thus, when the barrier 10 is positioned on horizontal terrain, as shown in FIG. 19, the rails 18 will be disposed substantially horizontally. When the barrier 10 is installed on a slanted terrain, the rail 18 is preferably tilted, or "racked," to match the terrain's slope.

Figure 5:
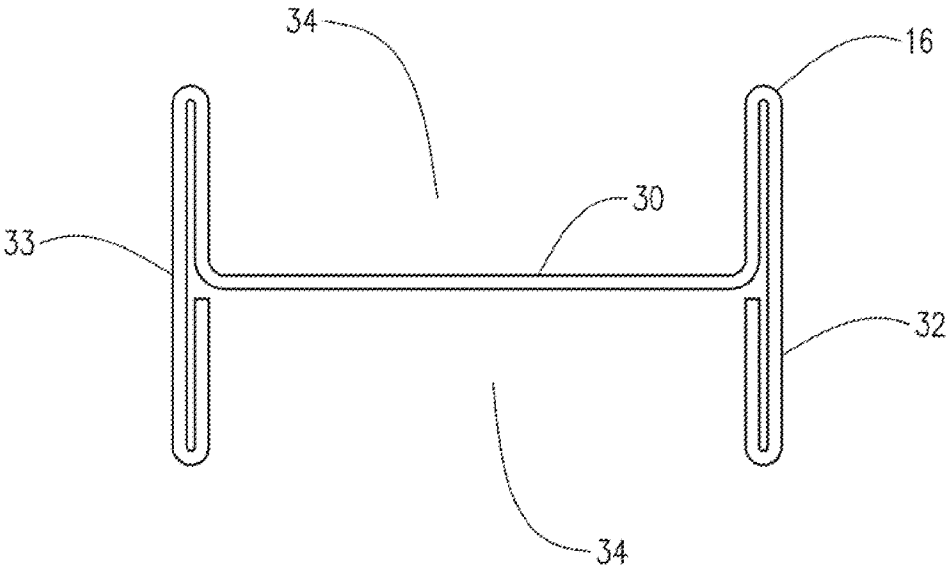
FIG. 5 is a top plan view of the rail shown in FIG. 4, taken along line 5-5.
Figure 6:
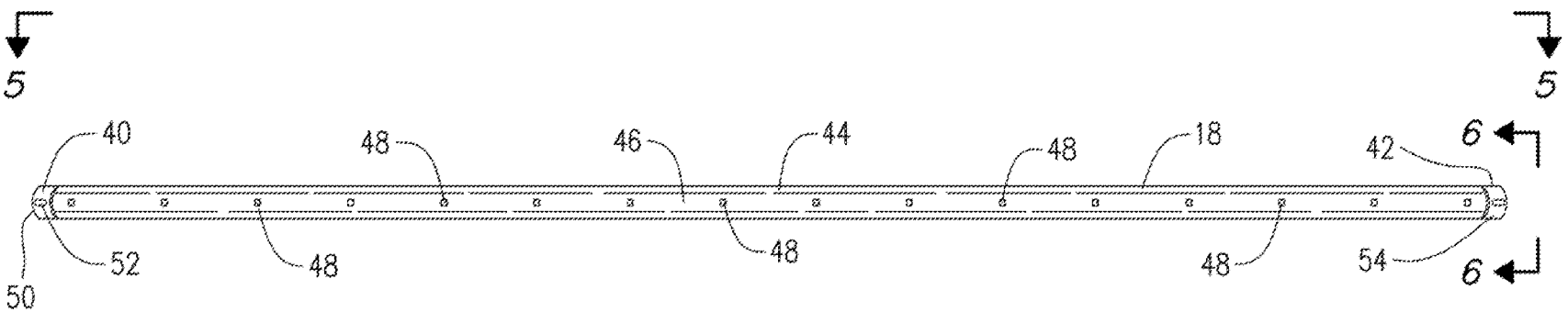
FIG. 6 is an end view of the rail shown in FIG. 4, taken along line 6-6.
Figure 4:
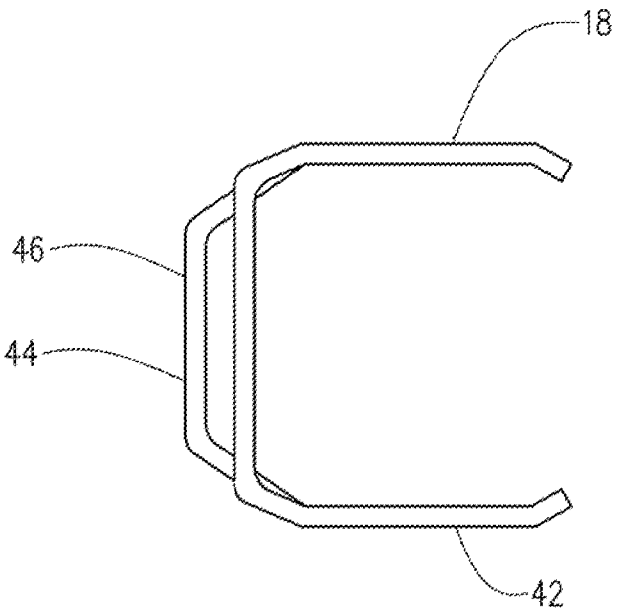
FIG. 4 is a front elevation view of a rail.

One of the rails 18 is shown in FIGS. 4-6. The rail 18 is an elongate channel-shaped member having opposed first and second end portions 40 and 42. An elongate intermediate portion 44 joins the end portions 40 and 42.

The intermediate portion 44 features an elongate flat section 46 that is disposed vertically in the assembled configuration of the barrier 10. Within the intermediate portion 44, the flat section 46 forms the base of the rail channel. Preferably, the intermediate portion 44 is symmetrical about a bisecting plane that extends orthogonally through the flat section 46.

In a preferred embodiment, the rail 18 has a maximum width of 2.111 inches, a height of 2.100 inches, and a length of 95 inches. The flat section 46 of the rail 18 has a width of 1.231 inches and a length of 92 inches.

As shown in FIG. 4, a plurality of longitudinally spaced and aligned fastener openings 48 are formed in the flat section 46. Preferably, the fastener openings 48 are identical in size and shape. A cloverleaf shape, which allows use of fasteners of differing shapes, is preferred. In the embodiment of the rail 18 shown in the Figures, there are 16 fastener openings 48, with a 6-inch separation distance between adjacent openings 48.

The first end portion 40 is sized to be fully received within each channel-shaped region 34 of the post 16. The first end portion 40 includes a planar, vertically-extending flat section 50 that is disposed in parallel, but recessed, relationship to the flat section 46 of the intermediate portion 44. In a preferred embodiment, the spacing between the respective flat sections is 0.25 inches.

At least one fastener opening, designated as a post attachment opening 52, is formed in the first end portion 40 of each rail 18. The post attachment opening 52 is preferably formed in the flat section 50 of the rail 18. Each post attachment opening 52 should be sized and positioned to register with a rail attachment opening 36 in the first flange 32 of post 16.

In a preferred embodiment, each post attachment opening 52 has an oblate shape with a major axis that extends parallel to the longitudinal axis of the rail 18. The width of the opening 52 is about 0.35 inches, and its maximum length is about 0.785 inches.

The second end portion 42 of the rail 18 is formed as a mirror image of the first end portion 40. The first and second end portions 40 and 42 are otherwise identical in size, shape and construction. The flat section 54 of the second end portion 42 is shown in FIG. 4. The flat section 54 is coplanar with the flat section 50 of the first end portion 40.

Each rail 18 is preferably formed from a strong and durable material, such as a strip of sheet steel. In a preferred embodiment, the steel is characterized by a thickness of 0.11 inches. To enhance its resistance to corrosion, this steel is preferably galvanized.

A punch press is used to form the attachment openings 38 and 52 in the galvanized steel that will be used to form the rail 18. The sheet is then subjected to a cold rolling process to produce a channel shaped member. At the end of this forming process, a cut-off die depresses flat section 50 relative to flat section 46. The die simultaneously cuts away excess material to form a finished rail. After these steps are complete, a polyester powder coating is preferably applied, to further enhance the rail's resistance to corrosion.

Further details of about the construction of the posts 16 and the rails 18 are provided in U.S. Pat. No. 8,382,070, the entire disclosure of which is incorporated by reference.

Figure 7:
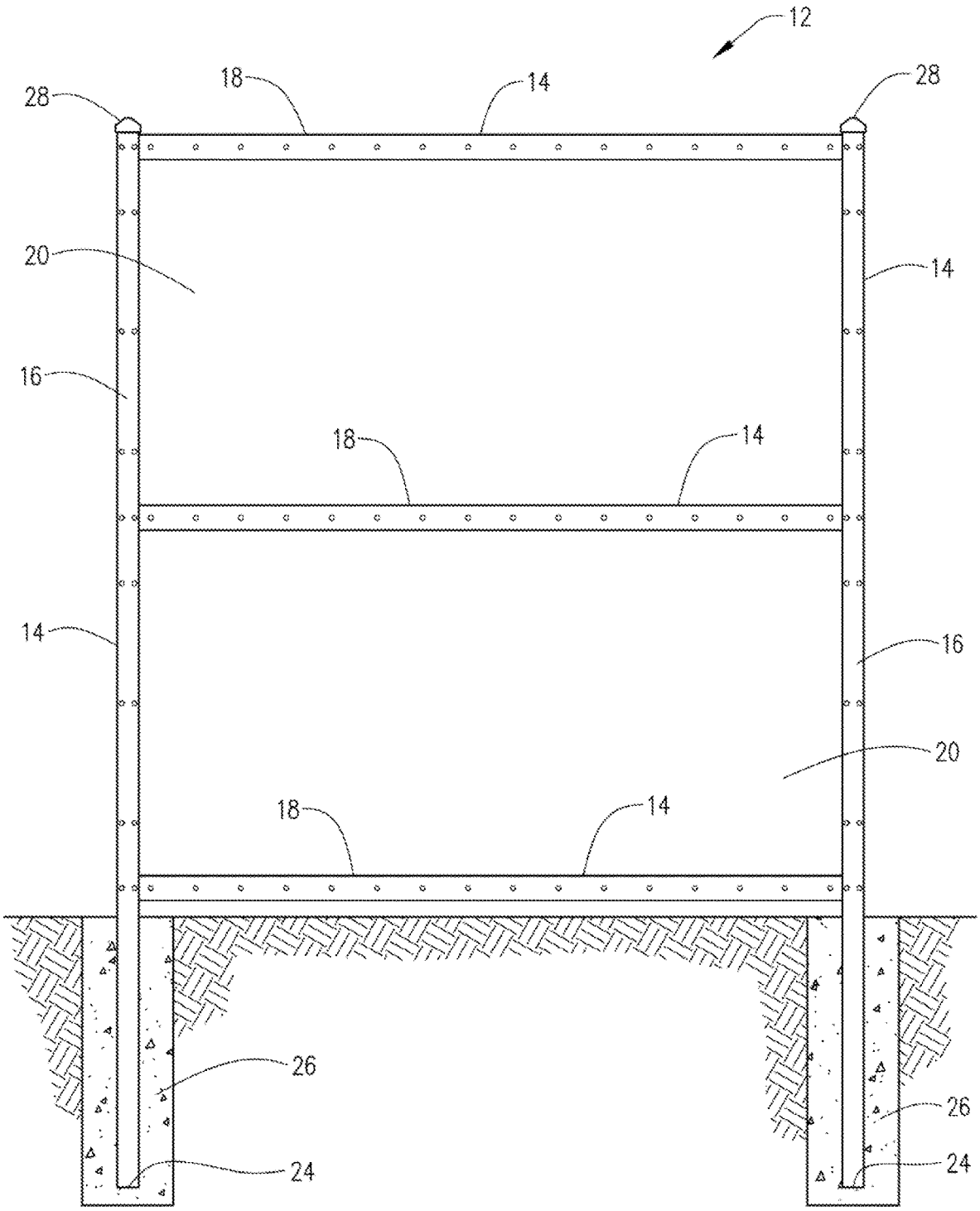
FIG. 7 is a front elevation view of a barrier undergoing an early stage of assembly, showing an assembled barrier framework. The supporting terrain and substrates are shown in cross section.
Figure 5:
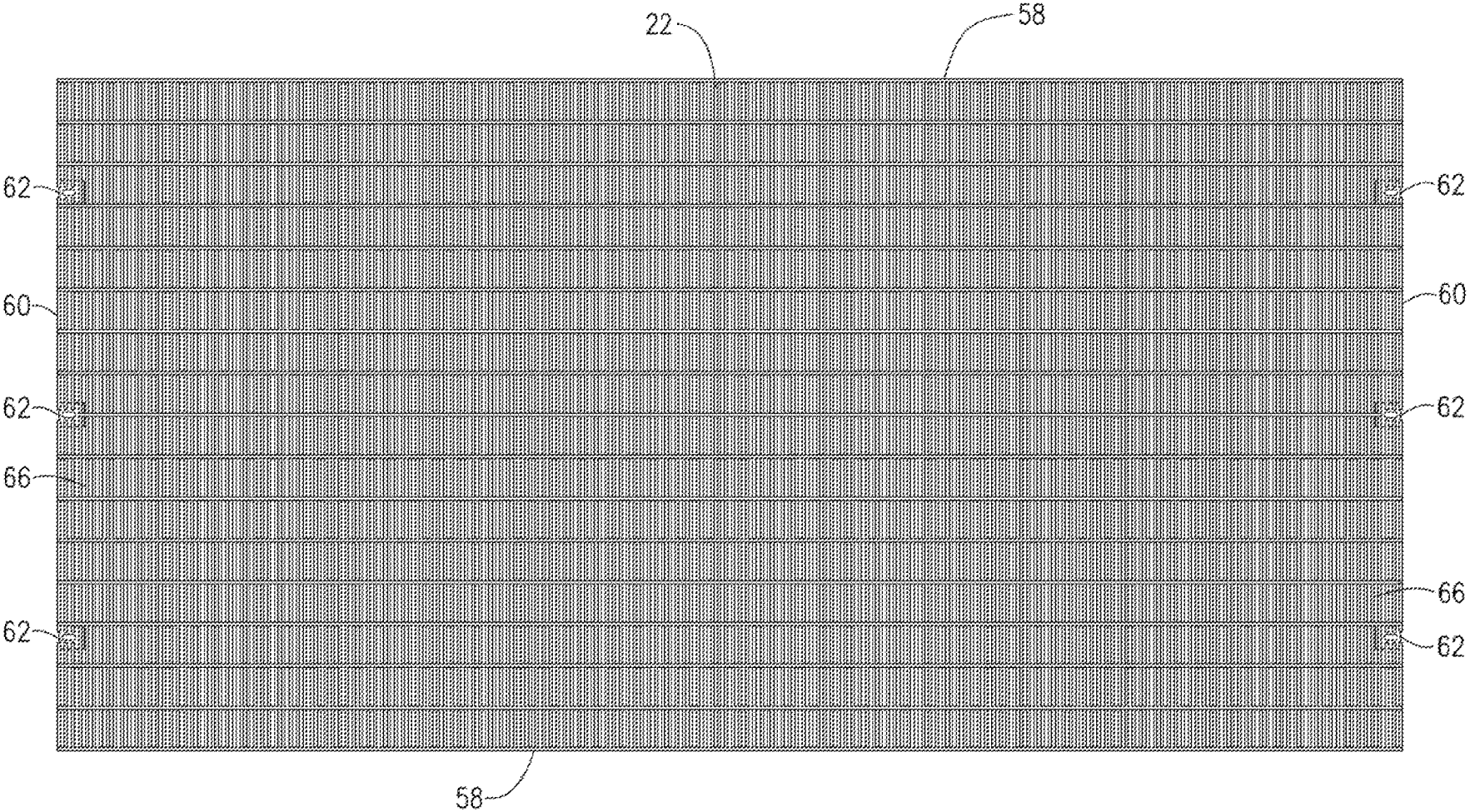

The next stage of assembly of the barrier 10, shown in FIGS. 7 and 22, involves attachment of the rails 18 to the posts 16. To attach a rail 18 to a post 16, the first end portion 40 of the rail 18 is first inserted into the post's channel-shaped region 34. The planar flat section 50 is placed flush against the planar inner surface of first flange 32, and the rail attachment opening 36 is aligned with the post attachment opening 52.

A fastener 56, shown in FIG. 22, is inserted through the aligned openings and actuated to secure the rail 18 to the post 16. The fastener 56 preferably comprises a nut and bolt assembly. The rail 18 is attached at its second end portion 42 to another post 16 that will form the barrier 10, using the same steps. Additional rails 18 are attached to posts 16 forming the barrier 10 in the same way. The resulting rail-post framework is shown in FIG. 7.

The infill sections 22 forming the barrier 10 are preferably identical in size, shape and construction. Each infill section 22 is formed from a strong and durable material, such as steel, that can resist penetration by an intruder. To enhance its resistance to corrosion, the infill section 22 is preferably galvanized and provided with a polyester powder coating.

The infill section 22 can be formed from any fencing fabric, and may be characterized by a meshlike structure. Suitable materials for the infill section 22 include wire, expanded metal, and louvered mesh. In a wire infill section 22, 6 or 8 gauge wire may be used.

One of the infill sections 22 is shown in FIG. 8. The infill section 22 is preferably characterized by rectangular boundaries, including a pair of spaced longitudinal edges 58 and a pair of spaced lateral edges 60. The infill section 22 is configured to fully cover at least one major opening 20 in the assembled barrier framework 12. The length of infill section 22, measured along longitudinal edge 58, should be sufficient to traverse at least the distance between an adjacent pair of posts 16 forming the barrier 10.

Preferably, the length of infill section 22 is no longer than required to traverse the distance between a single adjacent pair of posts 16. In the embodiment shown in the Figures, the infill section 22 is about 96 inches in length. In other embodiments, the infill section 22 may be twice as long, or three times or more as long, as the distance between a pair of adjacent posts 16.

The height of infill section 22, measured along lateral edge 60, should be sufficient to traverse at least the distance between a pair of adjacent vertically-spaced rails 18 forming the barrier 10. Preferably, the infill section 22 is no higher than required to traverse the distance between a pair of adjacent vertically-spaced rails 18. In the embodiment shown in the Figures, the infill section 22 has a height of about 48 inches. In another embodiment, the infill section has a height of about 60 inches.

Figure 9:
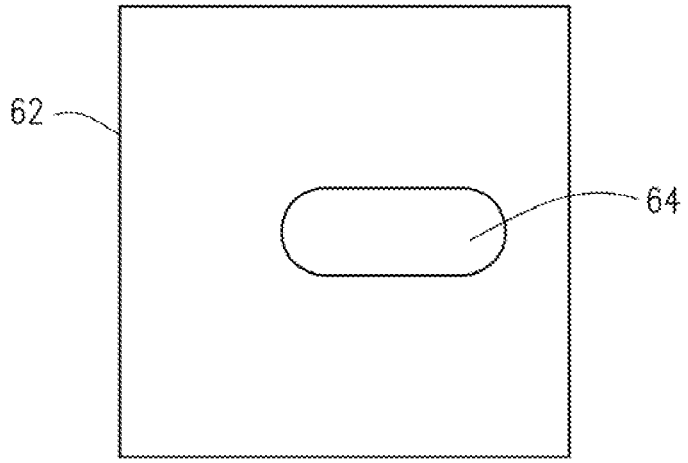
FIG. 9 is a front elevation view of a pad element.
Figure 10:
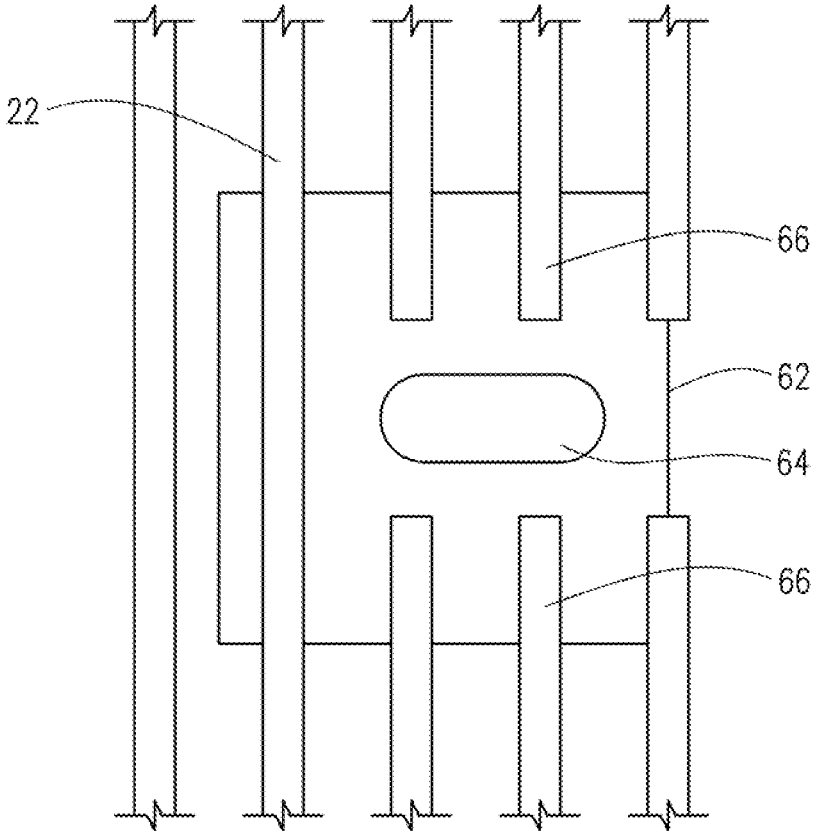
FIG. 10 is an enlarged view of a portion of the infill section of FIG. 8, showing one of its pad elements.

A plurality of pad elements 62 are supported by each infill section 22 within its rectangular boundaries, adjacent the lateral edges 60. The pad elements 62 are preferably identical in size, shape and construction. One such pad element is shown in FIGS. 9 and 10.

The pad element 62 is preferably rigid and formed from a strong and durable material, such as steel. Each pad element 62 is preferably rectangular, and more preferably square, in shape. In one embodiment, the pad element 62 is formed from 14 gauge galvanized steel, and is square with sides of 1.75 inches.

Each pad element 62 is penetrated by a post attachment opening 64. In a preferred embodiment, each post attachment opening 64 has an oblate shape. The width of the opening 64 is about 0.35 inches, and its maximum length is about 0.88 inches. Each post attachment opening 64 should be spaced from the edges of the pad element 62 in which it is formed.

The pad elements 62 are positioned on the same side of the infill section 22, with an equal number disposed adjacent each lateral edge 60. The pad elements 62 should be oriented such that the major axis of each post attachment opening 64 extends in parallel relationship to the adjacent lateral edge 60.

In the embodiment shown in FIG. 6, in which the height of the infill section 22 is about 48 inches, three pad elements 62 are supported on each lateral side of the infill section 22. The pad elements 62 nearest to each longitudinal edge 58 are spaced 6 inches therefrom. Adjacent pad elements 62 along each lateral edge 60 are spaced 16 inches apart.

In another embodiment of the infill section, with a height of about 60 inches, four pad elements are supported on each lateral side of the infill section. The pad elements nearest to each longitudinal edge are spaced 6 inches therefrom. Adjacent pad elements along each lateral edge are spaced 16 inches apart. In another embodiment of the infill section, with a height of about 36 inches, three pad elements are supported on each lateral side of the infill section.

The pad elements 62 are permanently secured to the fabric 66 forming the infill section 22, preferably by welding. As shown in FIG. 10, the fabric 66 is cut away such that it does not overlay the post attachment opening 64, thereby affording unobstructed access to the opening 64 by a fastener.

Figure 13:
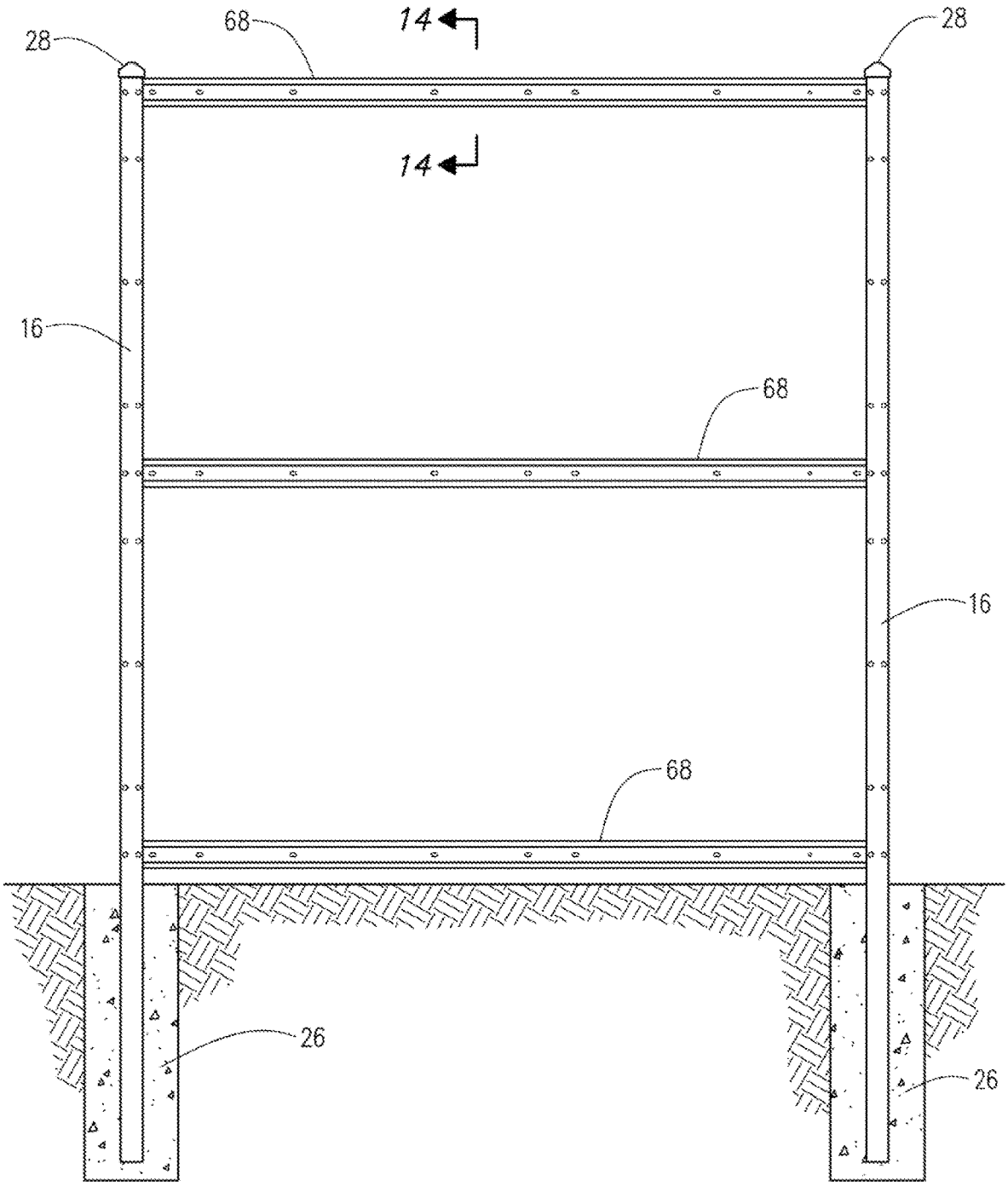
FIG. 13 is a front elevation view of a barrier undergoing assembly, at a later stage than that shown in FIG. 7. Junction elements have been installed on the rails of the barrier framework shown in FIG. 7.
Figure 14:
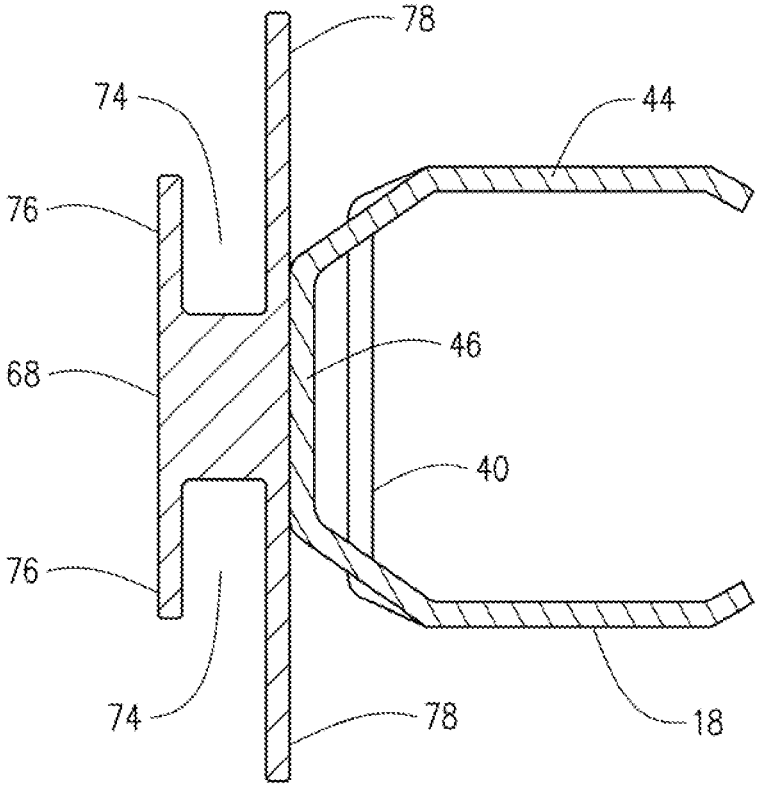
FIG. 14 is a cross-sectional view of the structure shown in FIG. 13, taken along line 14-14. Fasteners and posts have been omitted.

The next stage of assembly of the barrier 10, shown in FIGS. 13, 14 and 22, involves attachment of an elongate junction element 68 to each rail 18 of the barrier framework 12. The junction element 68 joins adjacent infill sections 22 that form the barrier 10.

Figure 11:
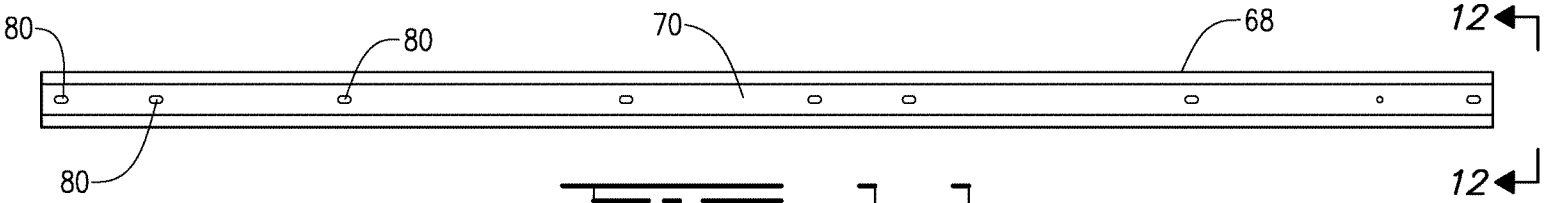
FIG. 11 is a front elevation view of a junction element.
Figure 12:
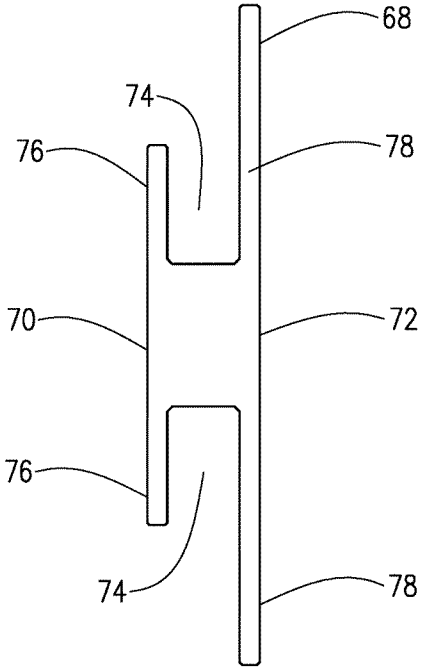
FIG. 12 is an end view of the junction element shown in FIG. 11, taken along line 12-12.

The junction elements 68 forming the barrier 10 are preferably identical in size, shape and construction. One such junction element 68 is shown in FIGS. 11 and 12. The junction element 68 has a first side 70 and an opposed second side 72, and is configured to overlay at least a portion of the length of one of the plurality of rails 18.

Preferably, each junction element 68 has a length that equals the length of the flat section 46 of one of the plurality of rails 18. In the embodiment shown in FIG. 19, the length of junction element 68 is 92.5 inches, which equals the length of the flat section 46 of the rail 18. Such a junction element 68 can wholly overlay the entire length of the rail 18.

As shown in FIG. 12, each junction element 68 has at least one elongate channel 74 within which at least a portion of the longitudinal edge 58 of one of the plural infill sections 22 may be received. More preferably, each junction element 68 is characterized by a pair of such channels 74, opening in opposite directions. Each channel 74 preferably has a thickness sufficient to receive and accommodate a range of different infill materials.

Each channel 74 of each junction element 68 is formed from a first channel wall 76, situated on first side 70, and a spaced second channel wall 78, situated on second side 72. The channel walls 76 and 78 are of different heights, with the first channel wall 76 having a shorter height than the second channel wall 78.

When the junction element 68 comprises a pair of opposed channels 74, the channels 74 are preferably of equal size and disposed in coplanar alignment. In such an embodiment, the first channel walls 76 of the respective channels may be formed as a single piece. Likewise, the second channel walls 78 of the respective channels may be formed as a single piece.

More preferably, the entire junction element 68, including channel walls 76 and 78, is formed as a single piece. In such an embodiment, shown in FIG. 12, the junction element 68 has an H-shaped cross-sectional profile, with arms on the first side 70 that are shorter than those of the second side 72.

In the embodiment shown in FIGS. 11 and 12, the junction element 68 has a thickness of about 0.6 inches. The thickness of each channel 74, between its opposed channel walls, is about 0.385 inches. Each first channel wall 76 has a height of 0.63 inches, and each second channel wall 78 has a height of 1.75 inches. The bases of the paired channels 74 are separated by 0.76 inches.

The junction element 68 is formed from a strong and durable material, such as aluminum or steel. In one embodiment, the junction element 68 is formed by extrusion with a 6005 T5 aluminum alloy. In another embodiment, the junction element 68 may be formed from galvanized steel, using a cold rolling process. After forming, each junction element 68 is preferably provided with a polyester powder coating, to enhance its resistance to corrosion.

Each junction element 68 is preferably penetrated by a plurality of longitudinally spaced and aligned fastener openings, designated as rail attachment openings 80. Each rail attachment opening 80 should be sized and positioned to register with a fastener opening 48 in the rail 18.

The number of rail attachment openings 80 may be smaller than the number of fastener openings 48 in the rail 18. In the embodiment shown in the Figures, each junction element 68 features nine rail attachment openings 80, with 6-, 12- or 18-inch spacing between adjacent openings.

The junction element 68 is installed by positioning it in wholly overlaying relationship to the flat section 46 of the rail 18. When the junction element 68 is so positioned, the rail attachment openings 80 should register in one-to-one relationship with the fastener openings 48.

The flat section 46 of the rail 18 serves as an attachment surface for the junction element 68. The junction element 68 is attached to the rail 18 by inserting a fastener 82, shown in FIG. 22, through the aligned openings 80 and 48. The fastener 82 is actuated to secure the junction element 68 against the flat section 46. The fastener 82 preferably comprises a screw.

Fasteners 82 are preferably actuated in all of the paired openings 80 and 48 except those that will register with junction attachment openings 92 in the cover element 86. The latter openings are preferably kept free of any fastener until a later stage of the assembly process. The remaining fasteners 82 are sufficient to maintain the junction elements 68 in place as assembly continues.

The installation steps for the junction element 68 are repeated for each rail 18 in the barrier 10. The installed configuration of the junction elements 68 is shown in FIGS. 13 and 14.

Figure 15:
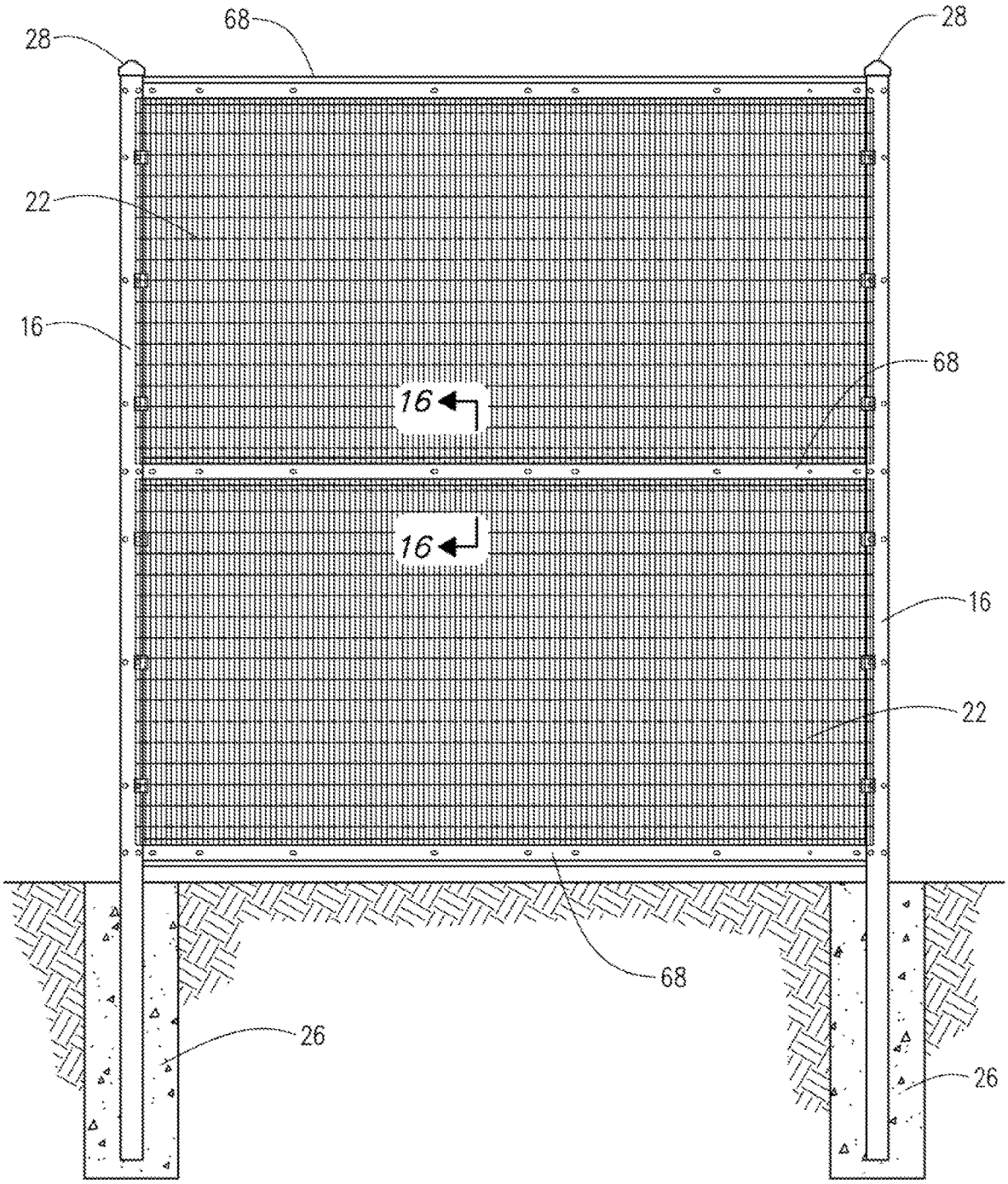
FIG. 15 is a front elevation view of a barrier undergoing assembly, at a later stage than that shown in FIG. 13. Sections of infill material have been installed on the structure shown in FIG. 13.

The next stage of assembly of the barrier 10, shown in FIGS. 15, 16 and 22, involves attachment of each infill section 22 to an adjacent pair of posts 16. This stage begins by inserting the spaced longitudinal edges 58 of an infill section 22 into the spaced channels 74 of a vertically-adjacent pair of junction elements 68.

Insertion of the infill section 22 continues until it fully covers a major opening 20 of the barrier framework 12. In a fully-inserted configuration, each post attachment opening 64 in the infill section 22 registers in one-to-one relationship with a corresponding infill attachment opening 38 in a post 16. The side of the infill section 22 that carries the pad elements 62 should be positioned immediately adjacent the post 16.

Fasteners 84, shown in FIG. 22, are inserted through the aligned openings 64 and 38. The inserted fastener is then actuated to secure the pad element 62 of the infill section 22 against the flat first flange 32 of the post 16. The fasteners 84 preferably comprise screws.

These steps are repeated for each post attachment opening 64 in each infill section 22 forming the barrier 10. The channels 74 of the junction elements 68 assist in holding the infill sections 22 in place as these attachment steps are carried out.

The installed configuration of the infill sections 22 is shown in FIGS. 15 and 16. In this configuration, each infill section 22 is firmly seated at its lateral edges 60 against the first flanges 32 of its associated posts 16.

The post attachment openings 52 in the infill section 22 are oriented at a 90 degree angle to the infill attachment openings 38 in the post 16. This difference in orientation allows the positioning of infill section 22 to be adjusted in either of two dimensions during installation.

Figure 18:
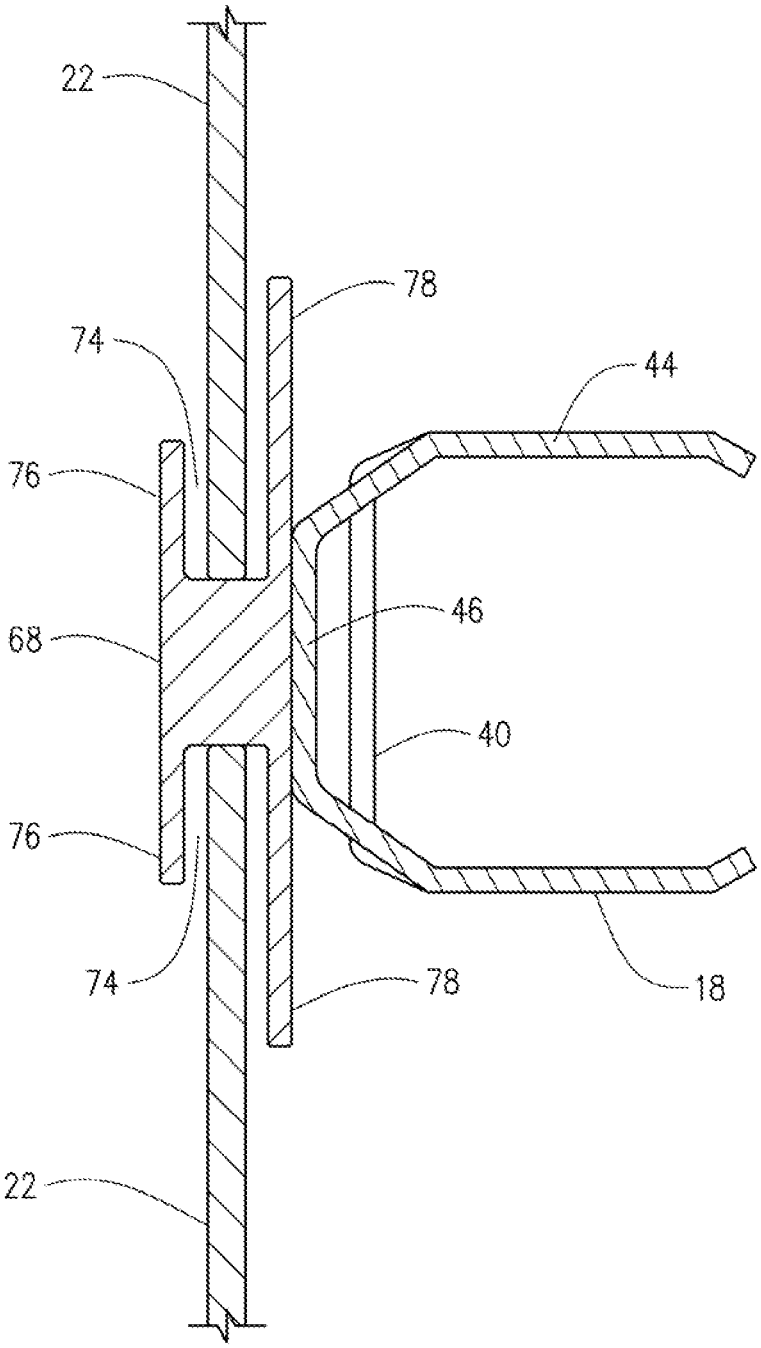
FIG. 18 is an end view of the cover element shown in FIG. 17, taken along line 18-18.

The final stage of assembly of the barrier 10, shown in FIGS. 18, 19 and 22, involves attachment of an elongate protective cover element 86 to each junction element 68 in the barrier 10.

Figure 17:
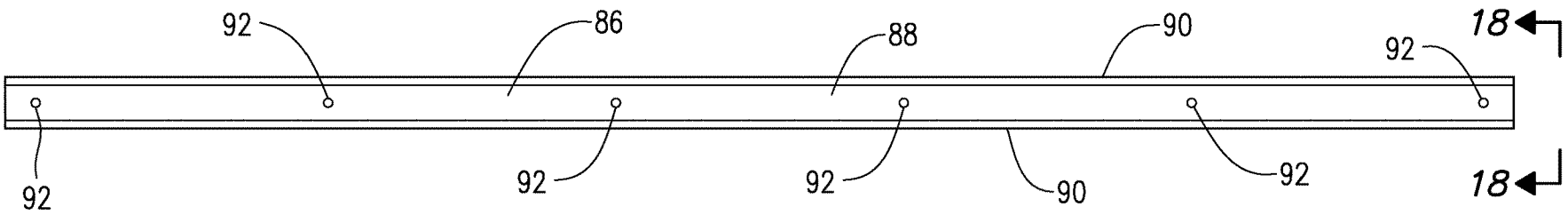
FIG. 17 is a front elevation view of a cover element.
Figure 18:
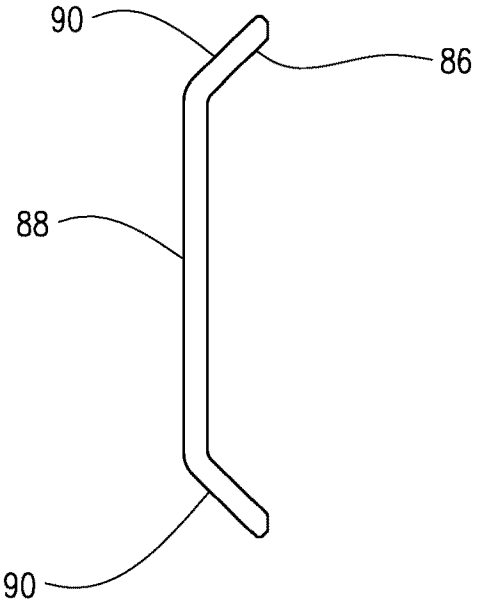
Figure 13:
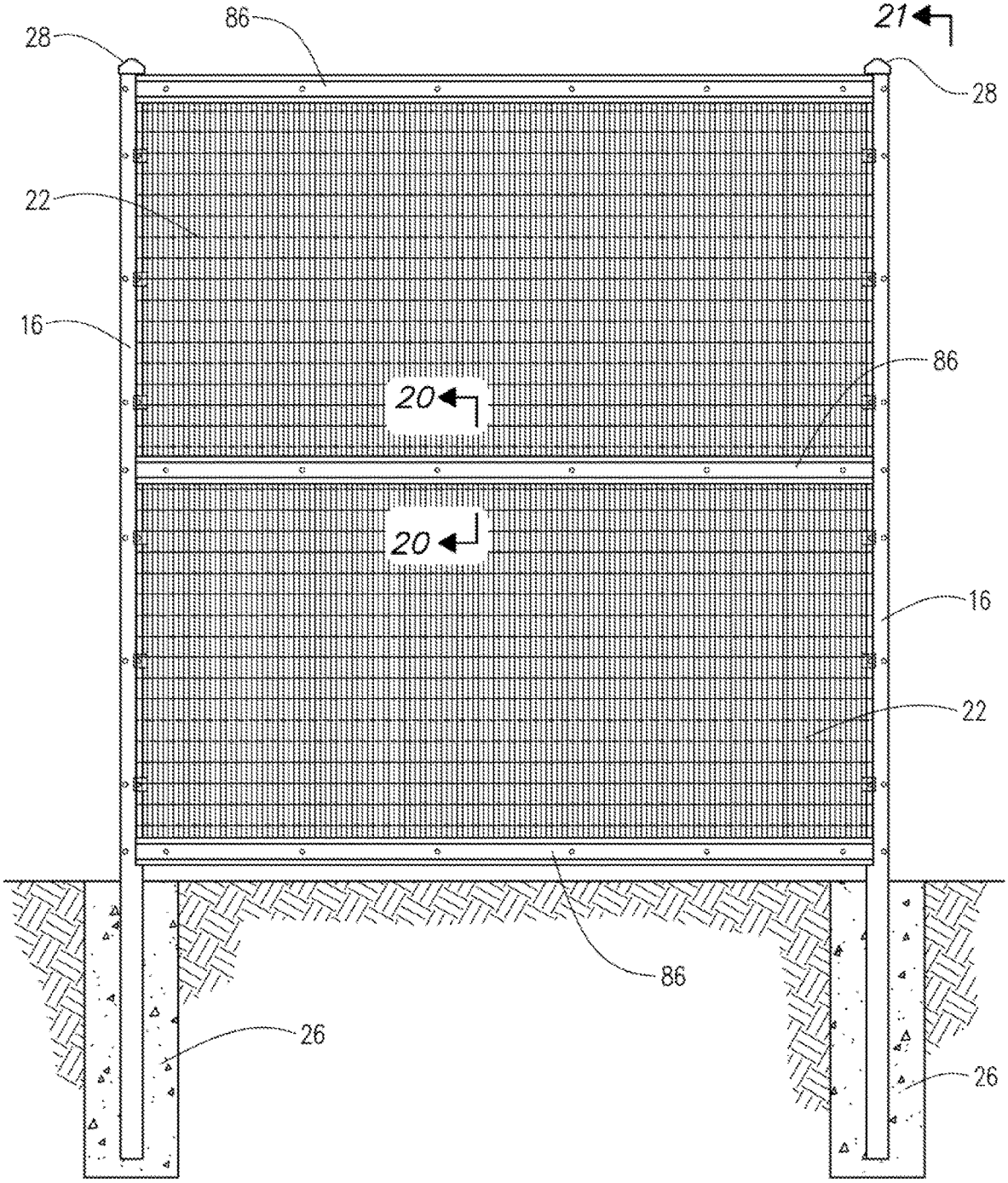

The cover elements 86 forming the barrier 10 are preferably identical in size, shape and construction. One such cover element 86 is shown in FIGS. 16 and 17. The cover element 86 is configured to overlay and enclose at least of portion of the length of one side of the junction element 68. More preferably, each cover element 86 is configured to overlay and enclose the entire length of the first side 70 of the junction element 68.

The cover element 86 is characterized a flat elongate web 88 that joins flat side walls 90. The side walls 90 diverge from the web 88. The cross-sectional profile of the cover element 86 is uniform along its length, and is substantially C-shaped.

The length of the cover element 86 is preferably substantially equal to the length of the infill section 22, and should exceed the length of the junction element 68. The width of the cover element 86 should exceed the width of the first side 70 of the junction element 68. In one embodiment, the length of the cover element 86 is 95 inches, with a width of 3.24 inches. In the same embodiment, the length of the junction element 68 is 92.5 inches and the length of the infill section 22 is 95.5 inches.

The cover element 86 should be formed from a strong and durable material, such as galvanized steel or aluminum. Preferably, the cover element 86 is of single-piece construction. After forming, each cover element 86 is preferably provided with a polyester powder coating, to enhance its resistance to corrosion.

The web 88 of each cover element 86 is preferably penetrated by a plurality of longitudinally spaced and aligned fastener openings, designated as junction attachment openings 92. These junction attachment openings 92 should be sized and positioned to register with the aligned rail attachment openings 80 and fastener openings 48 that did not receive fasteners 82 during earlier assembly.

The number of junction attachment openings 92 may be smaller than the number of rail attachment openings 80 in the junction element 68. In the embodiment in the Figures, the cover element 86 includes six junction attachment openings 92, with 18-inch spacing between adjacent openings.

The cover element 86 is installed by positioning it such that it overlays and encloses the first side 70 of the junction element 68. In this configuration, the openings 92, 64 and 38 are aligned.

Figure 20:
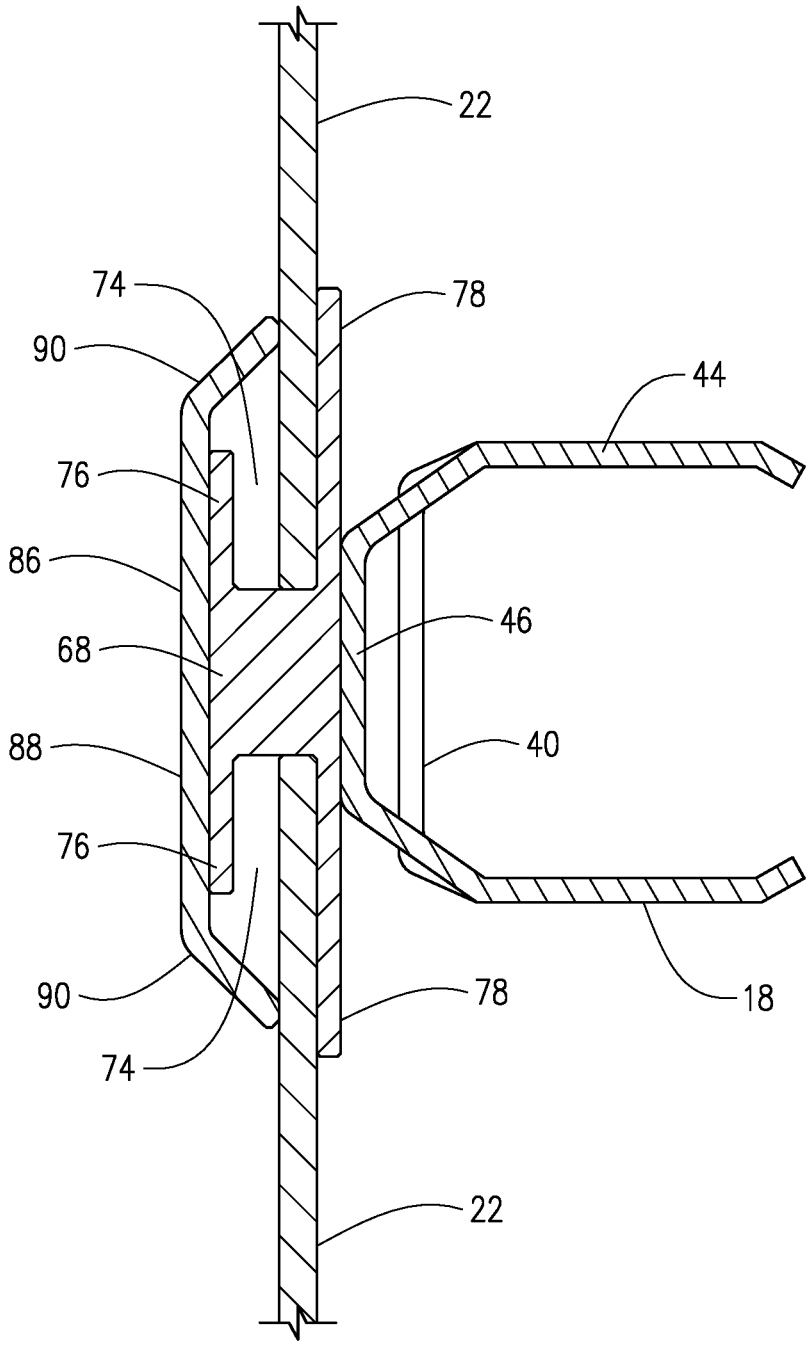
FIG. 20 is a cross-sectional view of the barrier shown in FIG. 19, taken along line 20-20. Fasteners and posts have been omitted.

Fasteners 94, shown in FIG. 22, are inserted through the aligned openings and actuated. Once the fasteners 94 are actuated, the side walls 90 of the cover element 86 clamp infill section 22 against the second channel wall 78 of the junction element 68, as shown in FIG. 20. The fasteners 94 preferably comprise screws.

Figure 21:
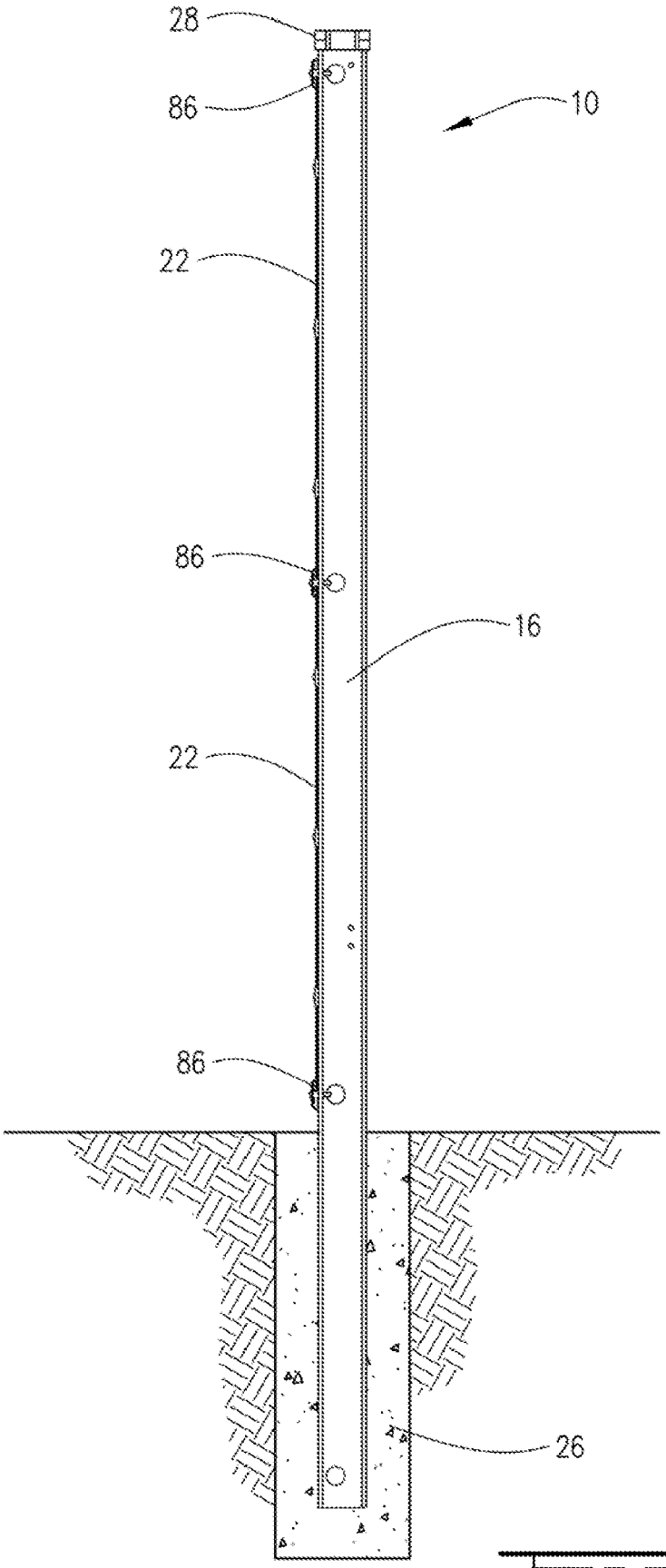
FIG. 21 is an end view of the barrier shown in FIG. 19, taken along line 21-21.

The installation steps for the cover element 86 are repeated for each junction element 68 in the barrier 10. The installed configuration of the cover elements 86, and the assembled barrier 10, are shown in FIGS. 19-21.

Because of the clamping action of the cover element 86, the thickness of the infill section 22 need not closely match the limiting thickness of the channels 74 in the junction element 68. This allows a single junction element 68 to function with infill sections 22 of differing thicknesses.

The cover elements 86 cooperate with the junction elements 68 to provide multi-layer protection for the edges of each infill section 22. In many barriers, such edges are vulnerable to prying, which can allow an intruder to remove the infill section and breach the barrier.

An assembled barrier includes one or more vertically-offset infill sections that are installed between each adjacent pair of posts. The number of vertically-spaced infill sections between each pair of posts, and the height of these infill sections, can be varied in different embodiments of the barrier. Through such variation, the collective height of the vertically-offset infill sections can be matched to the above-ground height of the posts.

Such embodiments may require additional rails, junction elements and cover elements to accommodate any additional infill sections needed for height matching. Other details of the construction of such barriers are identical to those described with reference to barrier 10 of FIG. 19.

In the embodiment shown in FIG. 19, a barrier 10 is formed from posts 16 having an above-ground height of about 8 feet. Two vertically-offset infill sections 22, each about 48 inches in height, are used to match the above-ground height of the posts 16.

In another embodiment, a barrier is formed from posts having an above-ground height of about 10 feet. Two vertically-offset infill sections, each about 60 inches in height, are used to match the above-ground height of the posts.

Figure 23:
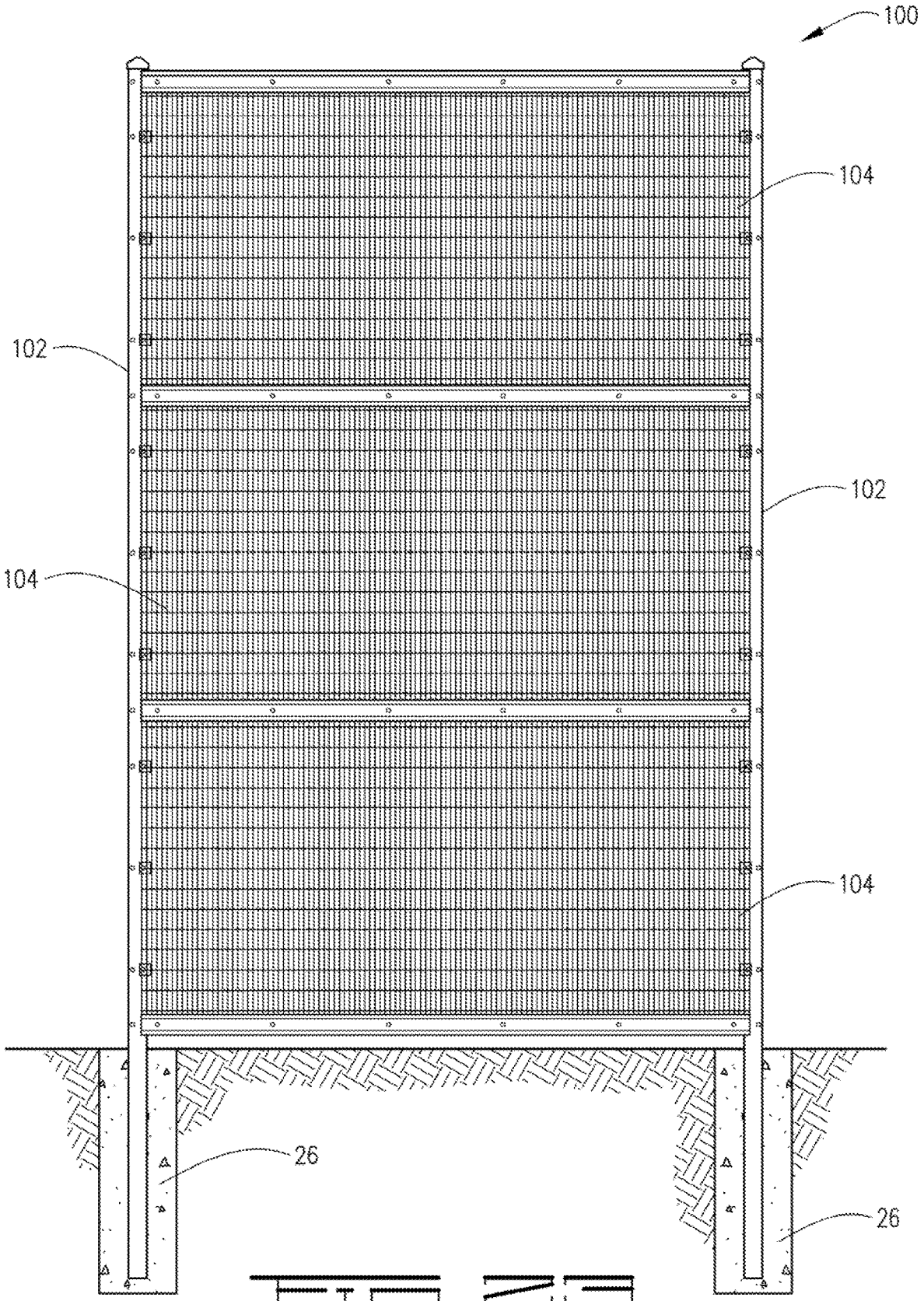
FIG. 23 is a front elevation view of another embodiment of a barrier, incorporating a set of three vertically offset infill sections.

In another embodiment, shown in FIG. 23, a barrier 100 is formed from posts 102 having an above-ground height of about 12 feet. Three vertically-offset infill sections 104, each about 48 inches in height, are used to match the above-ground height of the posts 102.

A barrier may be assembled from a kit. Such a kit should include a plurality of frame components, preferably identical to the frame components 14, including posts 16 and rails 18. The frame components are preferably provided in a number sufficient to form a barrier framework, or a section thereof.

The kit should further include a plurality of infill sections, preferably identical to the infill sections 22. The infill sections are preferably provided in an number sufficient to cover major openings of a barrier framework, or section thereof, assembled from the kit.

The kit should further include a plurality of junction elements, preferably identical to the junction elements 68. The junction elements are preferably provided in an number sufficient to cover the rails included in the kit.

The kit preferably further includes a plurality of cover elements, preferably identical to the cover elements 86. The cover elements are preferably provided in a number sufficient to cover the junction elements included in the kit.

The kit preferably further includes a plurality of fasteners, preferably including one or more of each of the fasteners 56, 82, 84 and 94. The fasteners should be provided in a number sufficient to permit assembly of other kit components into a barrier, or a section thereof.

Changes may be made in the construction, operation and arrangement of the various parts, elements, steps and procedures described herein without departing from the spirit and scope of the invention as described in the following claims.

The invention claimed is:

1. A kit, comprising:

a plurality of frame components configured to form an assembled barrier framework in which the frame components cooperate to bound a plurality of major openings, comprising:

a plurality of elongate posts; and a plurality of elongate rails, each of said rails having a length;

a plurality of infill sections, each infill section having a pair of spaced longitudinal edges and being configured to fully cover at least one major opening in the assembled barrier framework;

a plurality of elongate junction elements, each junction element having a length and a pair of opposed and elongate sides, each of which sides has a length and a width, and each junction element being configured to extend along and overlie at least a portion of the length of an external lateral surface of one of the plurality of rails, said each junction element having at least one elongate channel within which at least a portion of one of the said longitudinal edges of one of the said plurality of infill sections is receivable; and a plurality of cover elements, each cover element having a length and being configured to overlie and enclose the entire width of at least a portion of the length of one side of one of said junction elements.

2. The kit of claim 1 in which each of said cover elements is configured to overlie and enclose the entire length of one side of one of the junction elements.

3. The kit of claim 2 in which the length of said each cover element exceeds the length of said each junction element.

4. The kit of claim 1 in which each channel of said each junction element is formed from spaced first and second channel walls of different heights, and in which said each cover element is configured to overlie and enclose the first channel wall and to clamp an infill section against the second channel wall.

5. The kit of claim 4 in which one of the said plurality of junction elements includes oppositely-opening first and second channels, each said channel having a base and being bounded in part by spaced first and second channel walls, the second channel wall of each channel having a greater above-base height than the first channel wall, and in which one of the said plurality of cover elements has an elongate web that joins a pair of spaced side walls that diverge from the web, each of said side walls having a free edge, the cover element configured to engage the said one junction element such that the web fully overlies both of said first walls and each free edge overlies a corresponding one and only one of said second walls, while not overlying either of said first walls.

6. The kit of claim 1 in which at least one junction element is characterized by a pair of aligned channels within each of which said channels said at least a portion of the longitudinal edge of one of the said plurality of infill sections may be received, the said pair of aligned channels opening in opposite directions.

7. The kit of claim 6 in which each of said channels of the at least one junction element is formed from spaced first and second channel walls of different heights, and in which at least one cover element is configured to overlie and enclose the first channel wall of said channel and to clamp an infill section against the second channel wall of said channel.

8. The kit of claim 1 in which said each cover element and said each junction element are provided with a plurality of longitudinally spaced fastener openings, and in which the number of fastener openings in said each cover element is less than the number of fastener openings in said each junction element.

9. The kit of claim 1 in which said each infill section is characterized as having rectangular boundaries including a pair of spaced lateral edges, and in which a plurality of pad elements are supported within the said rectangular boundaries, adjacent the lateral edges.

10. The kit of claim 9 in which each post is provided with a plurality of fastener openings, and in which each pad element of said each infill section is provided with a fastener opening, with the fastener opening of each pad element of said each infill section alignable in one-to-one relationship with a fastener opening of said each post.

11. The kit of claim 1 in which each of the said at least one elongate channel of said each junction element has a channel base and is bounded in part by a pair of spaced channel walls, the said channel walls having different above-base heights.

12. The kit of claim 1 in which each of said cover elements is provided with a plurality of longitudinally spaced fastener openings.

13. A barrier, comprising:

an assembled barrier framework formed from the posts and rails of claim 1;

the elongate junction elements of claim 1, said each junction element overlying and engaging at least a portion of the length of a corresponding one of the said plurality of rails of the assembled barrier framework;

the infill sections of claim 1, each longitudinal edge of said each infill section received within the channel of one of said junction elements such that each infill section fully covers at least one major opening of the assembled barrier framework; and the cover elements of claim 1, said each cover element overlying and enclosing at least a portion of the length of one side of a corresponding one of the junction elements.

14. The barrier of claim 13 in which the infill sections include noncontiguous first and second infill sections, in which one of the said junction elements includes oppositely-opening first and second channels, in which at least a portion of one of the said longitudinal edges of the first infill section is received within the first channel, and in which at least a portion of one of the said longitudinal edges of the second infill section is received within the second channel.

15. A kit, comprising:

a plurality of frame components configured to form an assembled barrier framework in which the frame components cooperate to bound a plurality of major openings, comprising:

a plurality of elongate posts; and a plurality of elongate rails;

a plurality of infill sections, each infill section having a pair of spaced longitudinal edges and being configured to fully cover at least one major opening in the assembled barrier framework; and a plurality of elongate junction elements, each junction element being configured to extend along and overlie at least a portion of the length of an external lateral surface of one of the plurality of rails, each junction element having at least one elongate channel within which at least a portion of a longitudinal edge of one of the said plurality of infill sections is receivable, each said channel having a base and being bounded in part by a pair of spaced channel walls, the said channel walls having different above-base heights.

16. The kit of claim 15 in which said each junction element has a length and a pair of opposed sides, each of which sides has a length, and further comprising:

a plurality of cover elements, each cover element having a length and being configured to overlie and enclose at least a portion of the length of one side of a junction element.

17. The kit of claim 16 in which said each cover element is configured to overlie and enclose the entire length of one side of one of the junction elements.

18. The kit of claim 17 in which the length of each cover element exceeds the length of each said junction element.

19. The kit of claim 16 in which each said cover element is configured to overlie and enclose the first channel wall and to clamp an infill section against the second channel wall.

20. The kit of claim 15 in which at least one junction element is characterized by a pair of aligned channels within each of which said channels at least a portion of the longitudinal edge of one of the said plurality of infill sections is receivable, the said pair of aligned channels opening in opposite directions.

21. The kit of claim 20 in which at least one cover element is configured to overlie and enclose the first channel wall of said channel and to clamp an infill section against the second channel wall of said channel.

22. The kit of claim 15 in which said each infill section is characterized as having rectangular boundaries including a pair of spaced lateral edges, and in which a plurality of pad elements are supported within the said rectangular boundaries, adjacent the lateral edges.

23. The kit of claim 22 in which each post is provided with a plurality of fastener openings, and in which each pad element of said each infill section is provided with a fastener opening, with the fastener opening of each pad elements of said each infill section alignable in one-to-one relationship with a fastener opening of said each post.

24. The kit of claim 15 in which one of the said plurality of junction elements includes oppositely-opening first and second channels, each said channel having a base and being bounded in part by spaced first and second channel walls, the second channel wall having a greater above-base height than the first channel wall, and further comprising:

a plurality of a cover elements, each cover element being configured to overlie and enclose at least a portion of the length of one side of a junction element;

in which one of the said plurality of cover elements has an elongate web that joins a pair of spaced side walls that diverge from the web, each of said side walls having a free edge, the cover element configured to engage the said one junction element such that the web fully overlies both of said first walls and each free edge overlies a corresponding one and only one of said second walls, while not overlying either of said first walls.

25. A barrier, comprising:

an assembled barrier framework formed from the posts and rails of claim 15;

the elongate junction elements of claim 15, said each junction element overlying and engaging a corresponding one of the plurality of rails of the assembled barrier framework; and the infill sections of claim 15, each longitudinal edge of said each infill section received within the channel of a junction element, each infill section fully covering at least one major opening of the assembled barrier framework.

26. The barrier of claim 25 in which the infill sections include noncontiguous first and second infill sections, in which one of the said junction elements includes oppositely-opening first and second channels, in which at least a portion of one of the said longitudinal edges of the first infill section is received within the first channel, and in which at least a portion of one of the said longitudinal edges of the second infill section is received within the second channel.

* * * * *